United States Patent [19]

Müller

[11] Patent Number: 4,896,874

[45] Date of Patent: Jan. 30, 1990

[54] METHOD AND APPARATUS FOR TURNING CONTINUOUSLY CONVEYED FLAT STRUCTURES, ESPECIALLY ARRIVING IMBRICATED PRINTED PRODUCTS SUCH AS TO RETAIN THEIR ORIGINAL IMBRICATED FORMATION

[75] Inventor: Erwin Müller, Oberdürnten, Switzerland

[73] Assignee: Ferag AG, Hinwil, Switzerland

[21] Appl. No.: 37,960

[22] Filed: Apr. 13, 1987

[30] Foreign Application Priority Data

Apr. 18, 1986 [CH] Switzerland ..... 1579/86

[51] Int. Cl.[4] ..... B65H 29/00

[52] U.S. Cl. ..... 271/186; 271/205; 271/225; 271/902; 414/798.9

[58] Field of Search ..... 271/225, 186, 185, 184, 271/204, 205, 902; 414/29, 32, 33, 57; 198/404, 402

[56] References Cited

U.S. PATENT DOCUMENTS

| | | | |
|---|---|---|---|
| 3,642,274 | 2/1972 | Herrington et al. | 271/186 |
| 4,381,056 | 4/1983 | Eberle | 271/204 X |
| 4,526,362 | 7/1985 | Thierstein | 271/186 |
| 4,566,687 | 1/1986 | Faltin | 271/204 X |
| 4,604,851 | 8/1986 | Reist | 271/902 X |
| 4,606,173 | 8/1986 | Meier | 271/902 X |

FOREIGN PATENT DOCUMENTS

| | | | |
|---|---|---|---|
| 522596 | 6/1982 | Australia . | |
| 3102242 | 1/1981 | Fed. Rep. of Germany . | |
| 3417053 | 5/1984 | Fed. Rep. of Germany . | |
| 3404459 | 8/1985 | Fed. Rep. of Germany . | |
| 644816 | 2/1980 | Switzerland . | |
| 2121388 | 12/1983 | United Kingdom | 271/186 |

*Primary Examiner*—Joseph J. Rolla
*Assistant Examiner*—David H. Bollinger
*Attorney, Agent, or Firm*—Werner W. Kleeman

[57] ABSTRACT

Continuously conveyed flexible flat structures, especially printed products, infed in an imbricated formation, are turned such as to retain their original imbricated product formation. This is accomplished by accelerating the flexible flat structures such that they are singled and then in such singled condition are deflected about a deflection axis directed transverse to the product infeed conveying direction. Thereafter the singled turned flat structures are decelerated and transported away in an opposite conveying direction. Between an infeed device and an outfeed device for the structures there is arranged a deflection mechanism comprising at least one endless revolving driven traction element guided between its two substantially linearly extending runs about a deflection wheel. This traction element has mutually spaced outwardly extending carrier or support elements, at the outer ends of which there are mounted controlled grippers for engaging a respective one of the flat structures. The acceleration and deceleration of the controlled grippers and thus the flat structures respectively occurs during the run-on and run-off of the traction element at the deflection wheel, because then the outer ends of the outwardly protruding carrier or support elements carrying the grippers describe a substantially arcuate-shaped path which is appreciably longer than the wrapping path of the traction element about the deflection wheel.

18 Claims, 3 Drawing Sheets

10
50
13
23
49
28
31
32
36
II
25
22
48
34
24
26
19
18
17a
17b
17
20
12
16
14
11
15
46

METHOD AND APPARATUS FOR TURNING CONTINUOUSLY CONVEYED FLAT STRUCTURES, ESPECIALLY ARRIVING IMBRICATED PRINTED PRODUCTS SUCH AS TO RETAIN THEIR ORIGINAL IMBRICATED FORMATION

BACKGROUND OF THE INVENTION

The present invention relates to a new and improved method of, and apparatus for, turning or inverting continuously conveyed flat structures or products, especially substantially flat flexible products, particularly printed products, arriving or infed in an imbricated formation such as to retain their original infed imbricated formation after the flat structures have been turned or inverted.

The inverting or turning apparatus for the substantially flat flexible structures, in particular substantially flat printed products, comprises an infed device or means for the infeed of the substantially flat flexible structures and an outfeed device or means for the outfeed or delivery of the substantially flat flexible structures. In the case of printed products, especially newspapers or parts of newspapers, arriving in an imbricated formation, it frequently happens that the side of the printed product which is situated lowermost in the imbricated formation or product stream should be situated at the top or uppermost in such imbricated product stream for the further processing operation, for instance for the collating or assembling together of individual different printed products into a finished or final product. This turning or inversion of the previously situated lower side of the printed products so as to now constitute the upper side of the printed product is required so that in the final product the individual product parts are correctly oriented with regard to one another.

In order to accomplish turning or inversion of the products about axes extending substantially parallel to the product conveying direction it is known to twist the imbricated product formation, through the use of suitable guide facilities, in the product conveying direction through an angle of 180°. However, there is then annihilated the classical imbricated product formation wherein the leading edge of each printed product overlaps the trailing edge of the preceding or leading printed product. After twisting of the imbricated product stream through an angle of 180° as taught in the prior art discussed above, the imbricated product stream is oriented such that the trailing edge of each printed product overlaps the leading edge of the next following or successive printed product. Yet, this is disadvantageous for further processing of the printed products.

SUMMARY OF THE INVENTION

Therefore, with the foregoing in mind it is a primary object of the present invention to provide a new and improved method of, and apparatus for, turning or inverting substantially flat flexible structures, especially printed products, in a manner which is not associated with the aforementioned shortcomings of the prior art.

Another and more specific object of the present invention relates to a new and improved method of, and apparatus for, turning or inverting substantially flat structures, especially substantially flat flexible printed products, which allows such product inversion or turning operation to be accomplished without the need for any twisting or torsion of the path of movement of the products, and thus, when desired, allows retention of the original imbricated product formation.

Still a further significant object of the present invention is directed to a new and improved method of, and apparatus for, the turning or inversion of substantially flat flexible structures, especially although not exclusively printed products, in a manner which allows for an essentially exact replication of the incoming or inbound product formation to be achieved at the outbound or outgoing product formation.

A further significant object of the present invention is directed to a new and improved construction of an apparatus for the turning or inversion of substantially flat structures, especially although not exclusively printed products, in a highly exact and reliable fashion with great accuracy in the product turning or inversion operation to be accomplished so that there is maintained an essentially identical formation of the outbound or outfed product formation and the inbound or infed product formation, and wherein such apparatus is relatively simple in construction and design, relatively economical to manufacture, highly reliable in operation, not readily subject to breakdown or malfunction, and requires a minimum of maintenance and servicing.

Now in order to implement these and still further objects of the invention, which will become more readily apparent as the description proceeds, the method of the present development for the turning or inversion of continuously arriving substantially flat flexible structures, especially printed products arriving in an imbricated formation, is manifested by the features that the arriving or infed flat structures are individually seized, each such individually seized flat structure is singled from the infed or arriving imbricated product formation, deflected or turned about a deflection or turning axis directed transversely with respect to the conveying direction or predetermined path of travel of the infed imbricated product formation, whereupon the thus deflected or turned products are outfed in an opposite product conveying direction from that of the infed products.

As alluded to above the invention is not only concerned with the aforementioned method aspects, but also is directed to a new and improved apparatus for turning or inverting continuously arriving substantially flat flexible structures, in particular printed products, especially arriving or infed in an imbricated product formation, wherein a product deflection mechanism is arranged between the infeed means for infeeding the flat structures and the outfeed means for the outfeed or delivery of the flat structures. This deflection mechanism comprises at least one endless revolving traction element which is guided between two essentially linearly extending runs of such traction element about a deflection wheel. The traction element is provided with mutually spaced outwardly protruding or projecting carrier or support elements for the flat structures, and at the outer ends of such carrier or support elements there are mounted controlled grippers for individually seizing a respective flat structure or product.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
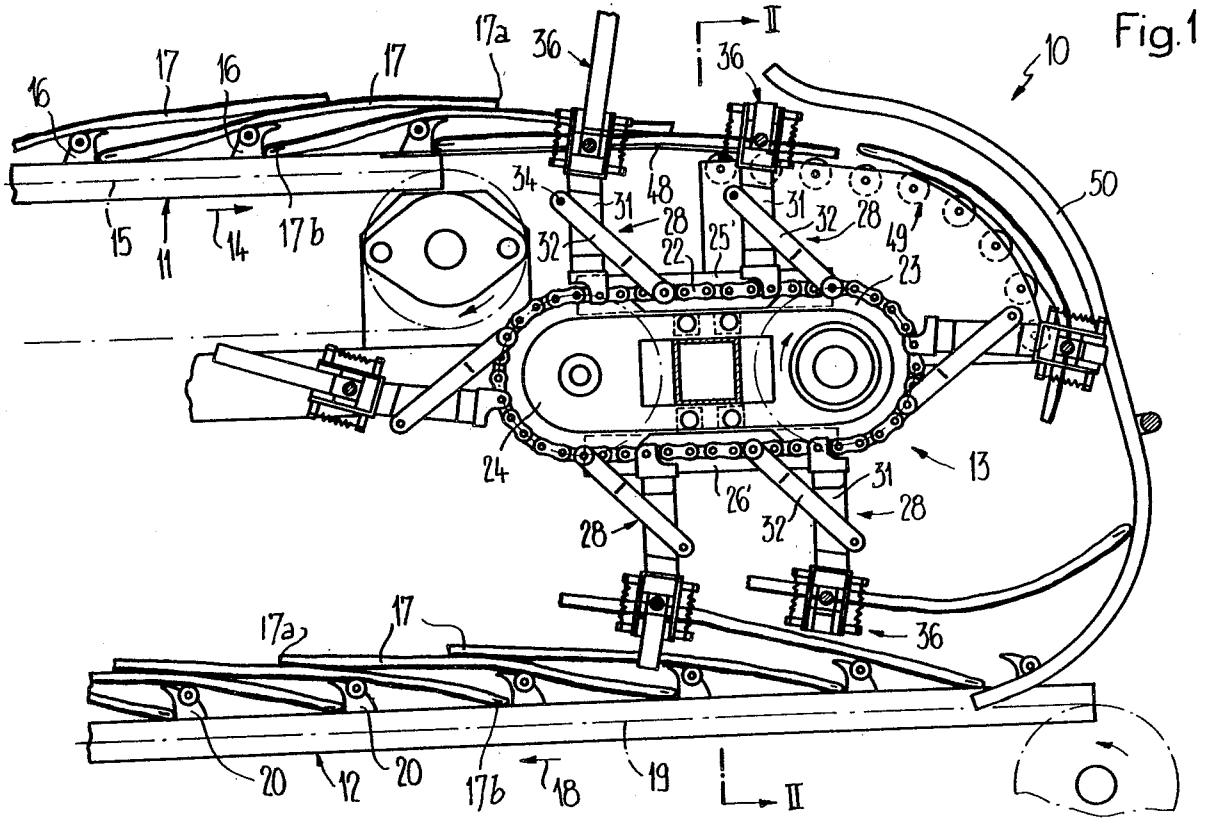
FIG. 1 is a side view of a portion of a first exemplary embodiment of apparatus for the turning or inverting of continuously arriving substantially flat flexible structures, typically for instance printed products arriving or infed in an imbricated product formation.

Describing now the drawings, it is to be understood that to simplify the illustration thereof there has been conveniently depicted therein only enough of the structure of the product turning or inverting apparatus as needed for one skilled in the art to readily understand the underlying principles and concepts of the present invention. Initially there will be considered the product turning or inverting apparatus depicted in the first exemplary embodiment portrayed in FIGS. 1 and 2. With the therein depicted product turning or inverting apparatus 10 there will be recognized an infeed or supply device 11, shown here as an infeed conveyor for infeeding the arriving substantially flat flexible structures, particularly printed products in an imbricated formation or product stream and an outfeed or delivery device 12, here shown as an outfeed conveyor for the outfeed or delivery of the turned or inverted flat structures or products. Between the infeed device 11 for conveying the imbricated formation in an infed conveying direction along a predetermined path of travel and the outfeed device 12 for outfeeding the processed products in an outfeed conveying direction opposite to the infeed conveying direction there is arranged a product deflection or turning mechanism 13 serving for turning or inverting the flat structures or products, as will be more fully discussed hereinafter.

The product infeed device 11 which is effective in the product conveying direction, generally indicated by the arrow 14, possesses an endless, guided chain or chain means 15 at which there are appropriately secured entrainment cams or lugs 16 arranged at a substantially uniform or equidistant spacing from one another. This conventional endless, guided chain or chain means 15 has been merely generally indicated in FIG. 1 by the depicted chain-dot lines. Each of the entrainment cams or lugs 16 advances or forwardly pushes a therewith associated flat structure, here depicted as a printed product 17. Furthermore, it is to be understood that the mutual spacing of the entrainment cams or lugs 16 from one another is less than the size or dimension of the printed product 17 measured in the product conveying or infeed direction 14, so that the leading product edge 17*a*, here assumed to be the cut edge or so-called flower portion of the printed product, overlaps the trailing edge 17*b*, in this case then the fold or product spine, of the preceding or leading printed product 17. The printed products 17 arrive in an orderly imbricated product formation or stream possessing a uniform so-called "imbrication spacing" or "imbrication pitch".

The product outfeed device 12 for the outgoing or delivered printed products 17 which have been turned or inverted, as will be described more fully hereinafter, is constructed analogous to the product infeed device 11. This outfeed device 12 is effective in the direction of the arrow 18 which represents the conveying direction for the outbound or outfed printed products 17 after they have been turned or inverted. Here also the outfeed device 12 comprises a conventional endless revolving, driven and guided chain or chain means 19 at which there are likewise secured entrainment cams or lugs 20 arranged in mutual spaced relationship from one another. These entrainment cams or lugs 20 similarly forwardly advance or push the now turned or inverted printed products 17 at the trailing edges 17*b* thereof. The spacing of the entrainment cams or lugs 20 from one another essentially corresponds to the mutual spacing of the entrainment cams or lugs 16 previously described and the velocity or speed of movement of the chain or chain means 19—apart from the indicated opposite direction of movement—essentially corresponds to that of the chain or chain means 15.

Figure 2:
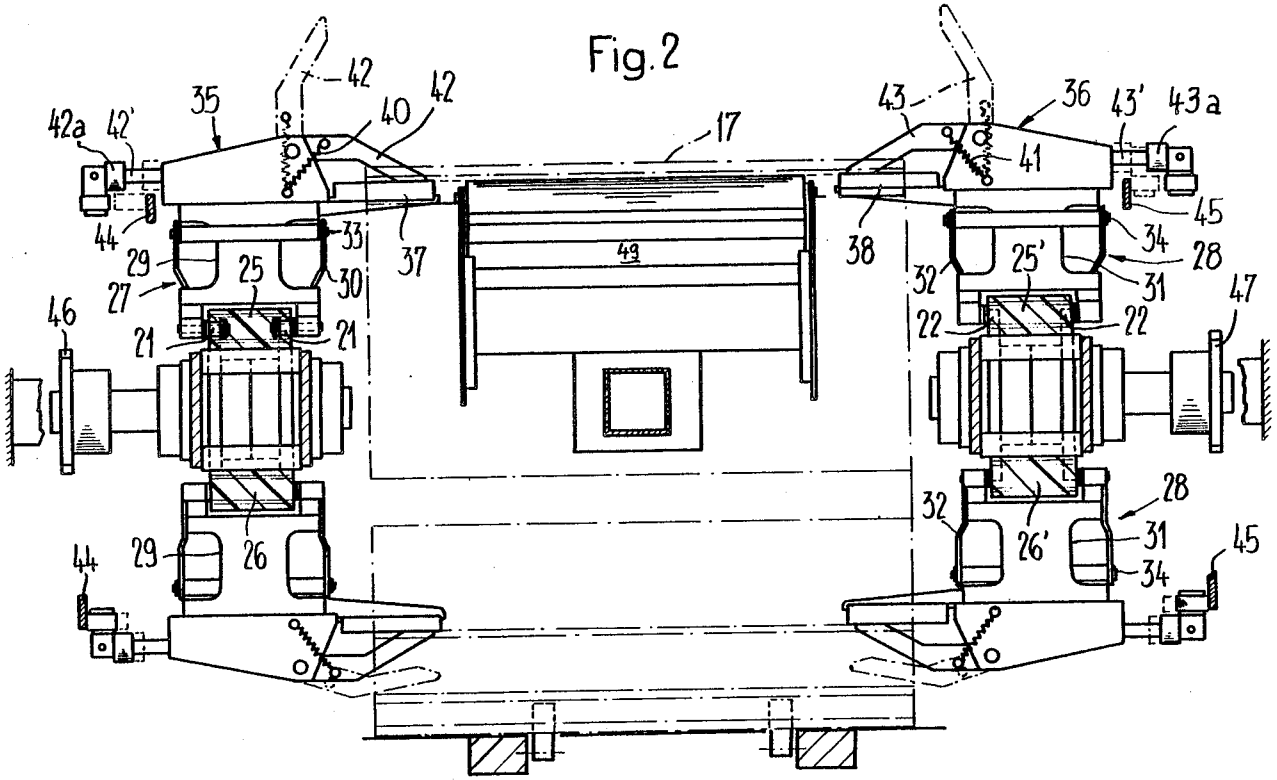
FIG. 2 is a somewhat schematic cross-sectional view of the product turning or inverting apparatus of FIG. 1, taken substantially along the line II—II thereof.

As best recognized by referring to FIG. 2, the deflection mechanism or deflection device 13 comprises two pairs of mutually parallel revolving chains 21—21 and 22—22 which are guided about deflection wheels 23 and 24 (FIG. 1) arranged in coacting pairs and having mutually parallel axes. Between these deflection wheels 23 and 24 these chains 21—21 and 22—22 are linearly guided at their upper and lower linear extending chain runs in upper rails or rail members 25, 25' and lower rails or rail members 26, 26'.

Each of the chain pairs 21—21 and 22—22 is equipped with a total of, for instance, six outwardly protruding or projecting carrier or support elements 27 and 28, respectively, the mutually spacing from one another, in the linear sections or runs of the chain pairs 21—21 and 22—22, essentially corresponds to the mutual spacing of the entrainment cams or lugs 16 from one another or that of the entrainment cams or lugs 20 from one another. Each of the carrier or support elements 27 and 28 comprises two link coupling elements or coupling means 29, 30 and 31, 32, respectively, which are hingedly connected with one another at their outer ends, at location 33 for the link coupling elements 29, 30 and at location 34 for the link coupling elements 31, 32 and at their inner ends are hingedly connected in spaced relationship from one another at related chain pairs 21—21 and 22—22, respectively, as best seen by referring to FIG. 2.

At their outer ends each of the carrier or support elements 27 and 28 is provided with a respective product gripper or clamp 35 and 36. Each such product gripper or clamp 35 and 36 comprises a stationary jaw or clamp element 37 and 38, respectively, which is fixed in relation to the associated link coupling element 29 and 31, respectively, and a pivotable jaw or clamp element 42 and 43, respectively, which can be pre-biased by respective springs 40 and 41 or equivalent biasing or loading elements towards the stationary or fixed jaws 37 and 38, respectively, in other words into the closed position. The pivotable jaws or clamp elements 42 and 43 are controllable from their closed position indicated in full lines into their open position indicated in chain-dot lines in FIG. 2 and back again by means of a not particularly illustrated suitable lever transmission or drive of which there are only visible a laterally protruding plunger 42' and 43', respectively, equipped with rolls 42*a* and 43*a* and the associated stationary cams or control elements 44 and 45, respectively.

The mutually parallel revolving chain pairs 21—21 and 22—22 are exactly synchronously driven with respect to one another each by means of a respective sprocket wheel 46 and 47 and here not particularly illustrated but standard associated chains, and specifically at the same velocity or speed of movement as the product conveying chains or chain means 15 and 19. The mutual spacing of the carrier or support elements 27 from one another and that of the carrier or support elements 28 from one another corresponds—as long as such carrier or support elements 27 and 28 are located upon the linear run of the associated chain pair 21—21 and 22—22, respectively, located between the deflection wheels 23 and 24—to the mutual spacing of the respective entrainment cams or lugs 16 from one another and to that of the entrainment cams or lugs 20 from one another.

From the foregoing it will be apparent that the grippers or clamps 35 and 36 travel in absolute synchronism with the printed products 17 or the like which are advanced or displaced by the product infeed device 11 onto the slide or support table 48 (at the top of FIG. 1), as long as their carrier or support elements 27 and 28 are located at the linear runs of the chain pairs 21—21 and 22—22, respectively. The slide or support table 48, upon which move the printed products 17, is of lesser width or crosswise extent than these printed products 17, so that such printed products 17 protrude past the slide or support table 48 at both sides of lateral ends thereof. Shortly before one of the carrier or support elements 27 and 28, namely its link coupling element 30 and 32, respectively, begins to run onto or make contact with the deflection wheel 23 at the region or location of its hinge or articulation point at the chain pair 21—21 and 22—22, respectively, the grippers or clamps 35 and 36 are closed. This has been shown in FIG. 1 at the upper right-hand portion thereof adjacent the section line II—II. Consequently, these grippers or clamps 35 and 36 seize or engage the printed products 17 located at the region thereof and specifically at their lateral edges or marginal regions.

Now since the carrier or support elements 27 and 28 protrude outwardly from the chain pairs 21—21 and 22—22, respectively, their outer ends, in other words the related grippers or clamps 35 and 36 experience an acceleration. These grippers or clamps 35 and 36 are thus accelerated for such length of time until the hinge or articulation points or locations of both the link coupling elements 30 and 32 as well as those of the link coupling elements 29 and 31 at the associated chain pairs 21—21 and 22—22, respectively, are located at the deflection wheel 23. Consequently, the printed products 17 are singled or separated from the trailing imbricated product formation and, due to the action of the associated grippers or clamps 35 and 36 the singled printed products 17 are individually deflected or turned about a deflection or turning axis which corresponds approximately to the rotational axis of the deflecting wheel 23. The deflection of the printed products 17 about the deflection axis describes a substantially arcuate-shaped product travel path, which, if desired, also may be of substantially elliptical configuration. The substantially arcuate-shaped or elliptical shaped path of travel has a starting portion extending substantially tangentially to the product infeed conveying direction 14.

As shown in FIG. 1, in order to support the printed products 17 during such product deflection operation and/or to prevent damage to such printed products by virtue of the prevailing centrifugal force, there is provided, on the one hand, a roll or roller track 49 intermediate these grippers or clamps 35 and 36 and which approximately follows the arcuate path of travel of such gripper elements 35 and 36 and, on the other hand, a guide rail or guide rail means 50 which follows the path of travel of the grippers or clamps 35 and 36 at the outside thereof.

As soon as the hinge or articulation points of the link coupling elements 30 and 32 at the associated chain pairs 21—21 and 22—22 depart from the related deflection wheel 23, there is initiated the deceleration phase of the carrier or support elements 27 and 28 and thus that of the grippers or clamps 35 and 36. This deceleration phase lasts for such length of time until the hinge or articulation points of the link coupling elements 29 and 31 at the associated chain pairs 21—21 and 22—22, respectively, have departed from the related deflection wheel 23. As a result the grippers or clamps 35 and 36 again travel at the same speed or velocity as the product outfeed device 12 and the grippers or clamps 35 and 36 can thus be opened, whereupon the associated printed product 17 is transferred to the product outfeed or delivery device 12. The substantially arcuate-shaped or, as the case may be, elliptcal-shaped path of travel through which the printed products 17 are deflected or turned has a terminal portion extending substantially tangentially to the outfeed or delivery conveying direction 18 of the turned or inverted printed products 17.

In FIG. 1 there has been indicated with a thick or fatter line the upper side or face, i.e. the upper surface, of the printed products 17 which arrive upon the product infeed device 11. When each such printed product 17 has reached the operative region of the outfeed or delivery device 12, this prior upper situated side or face or surface of such printed product 17 now is located at the bottom, but however the imbricated formation of the printed products 17 which was present at the product infeed device 11 is retained at the outfeed or delivery device 12 in the sense that the leading edge 17*a* of each printed product 17 overlaps the trailing edge 17*b* of the preceding or leading printed product 17. Each printed product 17 is thus turned or inverted about a deflection or turning axis extending transversely with respect to the product conveying direction and the original imbricated product formation is faithfully retained. Of course, the printed products 17 also could be infed upon the product infeed device 11 with the product fold or spine leading and the cut or flower portion of each product trailing and outfed in a comparable orientation upon the product outfeed or delivery device 12.

Figure 3:
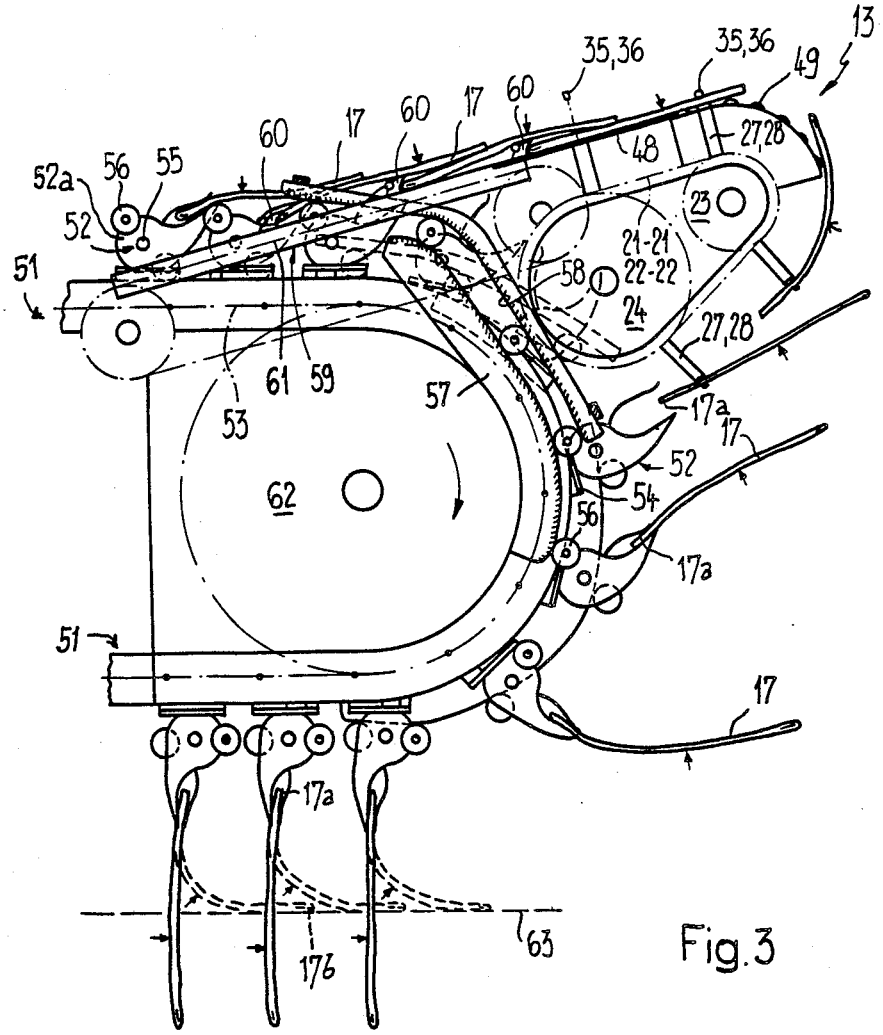
FIG. 3 illustrates in schematic portrayal a variant embodiment of the product turning or inverting apparatus, in a showing somewhat analogous to the illustration of FIG. 1.

The modified exemplary embodiment of product turning or inverting apparatus depicted in FIG. 3, in a somewhat analogous showing to the product turning or inverting apparatus 10 illustrated in FIG. 1, differs from the previously described exemplary embodiment particularly in that here there is used as the product infeed device or means and as the product outfeed device or means one and the same single or common conveyor 51. Such single or common product conveyor 51 is essentially of the same construction as described in Swiss Patent No. 644,816 and the generally cognate German Patent Publication No. 3,102,242.1 and the U.S. Pat. No. 4,381,056, granted Apr. 26, 1983, entitled "Conveyor Appartus, Especially for Printed Products", with one notable exception. This difference resides in the fact that its grippers or clamps 52 while being coupled at a uniform spacing from one another by means of a coupling element 54 at the merely generally schematically indicated chain or chain means 53, are however structured such that each gripper or clamp 52 is simultaneously hingedly connected or articulated in pivotable fashion at the coupling element 54 about a related pivot pin 55 which is directed transversely with respect to the chain or chain element 53. At the housing 52*a* of each of the grippers or clamps 52, which otherwise are controlled in the same manner as disclosed in the aforementioned patents into their open position and their closed position, respectively, there is additionally arranged a roll or roller member 56. Each such roll or roller member 56 coacts with stationary cams or control elements 57 and 58 or equivalent structure, so that in the final analysis these cams or control elements 57 and 58 or the like govern the pivotal position of the grippers or clamps 52 in relation to the chain or chain members 53.

The printed products 17 arriving at the upper run of the single or common conveyor 51 as depicted in FIG. 3 and in the same imbricated formation as the printed products arrive in the arrangement of FIG. 1, are taken over by an intermediate conveyor 59 which is constructed similar to the product infeed device 11 or the product outfeed device 12 previously described with reference to the embodiment of FIGS. 1 and 2. Moreover, the entrainment cams or lugs 60 of this intermediate conveyor 59 are secured at a greater spacing from one another at the only schematically indicated chain or chain element 51 than the mutual spacing of the grippers or clamps 52 at the chain or chain element 53. On the other hand, the conveying speed or velocity of the intermediate conveyor 59 is that much greater than that of the single or common conveyor 51 so that always one of the entrainment cams or lugs 60 meets one of the grippers or clamps 52.

Consequently, the entrainment cams or lugs 60 extract the printed products 17 out of the mouth of the now opened gripper or clamp 52 and push or advance such extracted printed product 17 in front of the related entrainment cam or lug 60 onto the slide or support table 48, where each such printed product 17 is acted upon or taken over by the merely schematically illustrated product deflection or turning mechanism 13. The carrier or support elements 27 and 28 which support the grippers or clamps 35 and 36 and which extend or project outwardly from the chains 21—21 and 22—22, in this case are not formed by two link coupling elements or couplers, rather are secured in a suitable fashion at the related chains 21—21 and 22—22 such that they protrude therefrom essentially at right angles.

The mutual spacing of the carrier or support elements 27 and 28 from one another corresponds to that of the entrainment cams of lugs 60 from one another and the circumferential velocity of the chains 21—21, 22—22, in this case, corresponds to that of the intermediate conveyor 59.

As a result, the grippers or clamps 35 and 36 and the printed products 17 engaged thereby suddenly have imparted thereto a greater velocity or speed of movement as soon as the related carrier or support element 27 and 28 and the associated chain 21—21 and 22—22, respectively, travel onto the deflection wheel 23 or equivalent structure, which in the embodiment under discussion is of smaller size than the deflection wheel 24 or equivalent structure.

As a result, the linear runs of the chains 21—21 and 22—22 between the deflection wheels 23 and 24 are not oriented parallel to one another. The so-to-speak "return run" of the chains 21—21 and 22—22, which appears at the lower portion of FIG. 3, extends essentially radially towards the deflection wheel 62 or the like of the single or common conveyor 51, at which the empty and still open grippers or clamps 52 have been brought in the meantime by the action of the cams or control elements 57 and 58 into a pivotal position which protrudes at essentially right angles from the chain or chain element or chain means 53. As a result, the leading edge 17*a* of each of the printed products 17 is engaged or seized by the grippers or clamps 52 and these printed products 17 are then outfed or delivered away while in a suspended state at the lower run of the single or common conveyor 51, as shown.

If the outfed or outbound printed products 17 are dragged over the slide or support table 63, indicated schematically by broken lines in FIG. 3, it will be apparent that the product formation in which there has been infed the printed products 17 has remained practically the same, that is to say, the "leading" 17*a* edge (here the cut or flower portion of the printed product) overlaps the trailing edge 17*b* (here the fold or spine) of the preceding or leading printed product. Also in this case the printed products 17 have been turned or inverted by the action of the deflection mechanism or device 13, since it will be observed that the uppe sides or surfaces of the infed printed products 17 and which have been indicated by a short arrow in FIG. 3 are now located in the so-to-speak "quasi"-imbricated formation at the bottom upon the slide or support table 63. During the course of this product inverting or turning operation the action of the grippers or clamps 52 has also been altered in the sense that, during the infeed of the printed products 17 these grippers or clamps 52 engaged the trailing edges 17*b* (in this case the product fold or spine) of such printed products 17 and during the outfeed of such printed products 17 these grippers or clamps 52 now engage the oppositely situated edges 17*a* (in this case the cut or flower portion) of the printed products 17.

While there are shown and described present preferred embodiments of the invention, it is to be distinctly understood that the invention is not limited thereto, but may be otherwise variously embodied and practiced within the scope of the following claims.

Accordingly, what I claim is:

1. A method for turning continuously conveyed substantially flat flexible structures, especially printed products, arriving in an imbricated formation, comprising the steps of:

conveying the substantially flat flexible structures during infeed thereof in an imbricated formation so as to move in an infeed conveying direction along a predetermined path of travel;

individually laterally seizing and accelerating the substantially flat flexible structures so as to single each such seized substantially flat flexible structure from the remaining imbricated formation of substantially flat flexible structures;

individually turning each such singled and laterally seized, accelerated substantially flat flexible structure about a deflection axis directed transversely with respect to said predetermined path of travel of the infed imbricated formation of substantially flat flexible structures while essentially maintaining a predetermined spacing between the turned substantially flat flexible structures;

at the end of said step of individually turning each such singled and laterally seized, accelerated substantially flat flexible structure, decelerating each said singled and seized, accelerated and turned substantially flat flexible structure; and thereafter releasing the singled and laterally seized, decelerated substantially flat flexible structures and forming and outfeeding an imbricated formation in an outfeed conveying direction opposite to the infeed conveying direction of the imbricated formation of the substantially flat flexible structures with leading edges of the infed imbricated formation remaining leading edges in the outfed imbricated formation.

2. The method as defined in claim 1, wherein:

the step of accelerating the singled substantially flat flexible structures is accomplished at the start of their deflection about said deflection axis.

3. The method as defined in claim 2, further including the steps of:

controlling the velocity of the infed imbricated formation of substantially flat flexible structures and the velocity of the outfed singled flat flexible structures so as to be essentially equal to one another.

4. The method as defined in claim 1, further including the steps of:

controlling the velocity of the infed imbricated formation of substantially flat flexible structures and the velocity of the outfed singled flat flexible structures so as to be essentially equal to one another.

5. The method as defined in claim 1, further including the steps of:

deflecting the substantially flat flexible structures along a substantially elliptical path of travel having a starting portion and a terminal portion; and the starting portion of said substantially elliptical path of travel being essentially tangential to the infeed conveying direction of the imbricated formation of substantially flat flexible structures and the terminal portion of the substantially elliptical path of travel being essentially tangential to the outfeed conveying direction of the outfed singled flat flexible structures following the deflection thereof about the deflection axis.

6. The method of as defined in claim 1, further including the steps of:

deflecting the substantially flat flexible structures along a substantially arcuate-shaped path of travel having a starting portion and a terminal portion; and the starting portion of said substantially arcuate-shaped path of travel being essentially tangential to the infeed conveying direction of the imbricated formation of substantially flat flexible structures and the terminal portion of the substantially arcuate-shaped path of travel being essentially tangential to the outfeed conveying direction of the outfed singled flat flexible structures following the deflection thereof about the deflection axis.

7. The method as defined in claim 1, further including the steps of:

outfeeding the deflected singled substantially flat flexible structures in an imbricated formation which essentially corresponds to the imbricated formation of the infed substantially flat flexible structures.

8. An apparatus for turning continuously conveyed substantially flat flexible structures, especially printed products, arriving in an imbricated formation, comprising:

means for infeeding the substantially flat flexible structures in an imbricated formation;

means for outfeeding the substantially flat flexible structures;

a deflection mechanism arranged between the infeed means and the outfeed means for the substantially flat flexible structures;

said deflection mechanism comprising at least one endless revolvingly driven traction element;

said deflection mechanism further comprising a deflection wheel;

said at least one endless revolvingly driven traction element comprising two essentially linearly extending runs;

said at least one endless revolvingly driven traction element being guided between said two essentially linearly extending runs about said deflection wheel;

a plurality of carrier elements carrying a plurality of controlled grippers and arranged in mutually spaced relationship from one another on said at least one endless revolving driving traction element;

said plurality of carrier elements protruding outwardly from said at least one endless revolving driven traction element;

each said carrier element having an outer end;

a respective one of said plurality of controlled grippers being mounted at the outer end of each said carrier element for laterally gripping an associated substantially flat flexible structure; and each said controlled gripper serving for individually grippingly engaging a flat structure for the controlled turning of the substantially flat flexible structures.

9. The apparatus as defined in claim 8, wherein:

said at least one endless revolving driven traction element has a circumferential velocity which at least corresponds to a predeterminate conveying speed of said infeed means and a predeterminate conveying speed of said outfeed means for the substantially flat flexible structures.

10. The apparatus as defined in claim 8, wherein:

each of said controlled grippers, which is carried at the outer end of the carrier element, moves through a predetermined path of travel; and guide means arranged at a region of the path of travel of the controlled grippers where the traction element is guided about the deflection wheel.

11. The apparatus as defined in claim 10, wherein:

said guide means comprise guide rail means for the substantially flat flexible structures.

12. An apparatus for turning continuously conveyed substantially flat flexible structures, especially printed products, arriving in an imbricated formation, comprising:

means for infeeding the substantially flat flexible structures in an imbricated formation;

means for outfeeding the substantially flat flexible structures;

a deflection mechanism arranged between the infeed means and the outfeed means for the substantially flat flexible structures;

said deflection mechanism comprising at least one endless revolvingly driven traction element;

said deflection mechanism further comprising a deflection wheel;

said at least one endless revolvingly driven traction element comprising two essentially linearly extending runs;

said at least one revolvingly driven traction element being guided between said two essentially linearly extending runs about said deflection wheel;

a plurality of carrier elements arranged in mutually spaced relationship from one another on said at least one endless revolving driven traction element;

said plurality of carrier elements protruding outwardly from said at least one endless revolving driven traction element;

each said carrier element having an outer end;

a controlled gripper mounted at the outer end of each said carrier element;

each said controlled gripper serving for individually engaging a flat structure;

said at least one endless revolving driven traction element comprising two pairs of substantially mutually parallel revolvingly driven chains;

each of said chains being provided with said outwardly protruding carrier elements; and said controlled grippers being structured to coact in pairs so as to engage opposite lateral edges of an associated flat structure infed to each said coacting pair of grippers.

13. The apparatus as defined in claim 12, wherein:

each of said carrier elements comprises two link coupling means;

each of said two link coupling means having a first end and a second end;

means for hingedly interconnecting said link coupling means at their first end; and means for hingedly connecting the second end of said link coupling means at two hinge locations located in spaced relationship from one another on an associated one of the chains.

14. The apparatus as defined in claim 13, wherein:

the spacing of the hinge locations of the link coupling means on the associated chains is less than the mutual spacing of successive carrier elements from one another.

15. An apparatus for turning continuously conveyed substantially flat flexible structures, especially printed products, arriving in an imbricated formation, comprising:

means for infeeding the substantially flat flexible structures in an imbricated formation;

means for outfeeding the substantially flat flexible structures;

a deflection mechanism arranged between the infeed means and the outfeed means for the substantially flat flexible structures;

said deflection mechanism comprising at least one endless revolvingly driven traction element;

said deflection mechanism further comprising a deflection wheel;

said at least one endless revolvingly driven traction element comprising two essentially linearly extending runs;

said at least one endless revolvingly driven traction element being guided between said two essentially linearly extending runs about said deflection wheel;

a plurality of carrier elements arranged in mutually spaced relationship from one another on said at least one endless revolving driven traction element;

said plurality of carrier elements protruding outwardly from said at least one endless revolving driven traction element;

each said carrier element having an outer end;

a controlled gripper mounted at the outer end of each said carrier element;

each said controlled gripper serving for individually engaging a flat structure;

each of said controlled grippers moving through a predetermined path of travel;

guide means arranged at a region of the path of travel of the controlled grippers where the traction element is guided about the deflection wheel; and said guide means comprising guide rolls for the substantially flat flexible structures.

16. An apparatus for turning continuously conveyed substantially flat flexible structures, especially printed products, arriving in an imbricated formation, comprising:

means for infeeding the substantially flat flexible structures in an imbricated formation;

means for outfeeding the substantially flat flexible structures;

a deflection mechanism arranged between the infeed means and the outfeed means for the substantially flat flexible structures;

said deflection mechanism comprising at least one endless revolvingly driven traction element;

said deflection mechanism further comprising a deflection wheel;

said at least one endless revolvingly driven traction element comprising two essentially linearly extending runs;

said at least one revolvingly driven traction element being guided between said two essentially linearly extending runs about said deflection wheel;

a plurality of carrier elements arranged in mutually spaced relationship from one another on said at least one endless revolving driven traction element;

said plurality of carrier elements protruding outwardly from said at least one endless revolving driven traction element;

each said carrier element having an outer end;

a controlled gripper mounted at the outer end of each said carrier element;

each said controlled gripper serving for individually engaging a flat structure;

a single conveyor means;

said single conveyor means being equipped with grippers for seizing an edge of each one of the substantially flat flexible structures which extends transversely with respect to a predetermined conveying direction of the substantially flat flexible structures;

said single conveyor means having a pair of conveyor runs;

said means for infeeding the substantially flat flexible structures being constituted by one run of said pair of runs of said single conveyor means; and said means for outfeeding the substantially flat flexible structures is constituted by the other run of the pair of runs of said single conveyor means.

17. An apparatus for turning infed substantially flat flexible structures, especially printed products, arriving in a predetermined formation, comprising:

means for infeeding the substantially flat flexible structures in an imbricated formation;

means for outfeeding the substantially flat flexible structures;

deflection means arranged between the infeed means and the outfeed means for the substantially flat flexible structures;

said deflection means comprising at least one endless revolvingly driven element;

said deflection means further comprising a deflection wheel;

said at least one endless revolvingly driven element comprising two runs;

said at least one endless revolvingly driven element being guided between said two runs about said deflection wheel;

a plurality of carrier elements carrying a plurality of grippers and arranged in mutually spaced relationship from one another on said at least one endless revolving driven element;

said carrier elements protruding outwardly from said at least one endless revolving driven element;

each said carrier element having an outer end;

a respective one of said plurality of grippers being mounted at the outer end of each said carrier element; and each said gripper serving for individually laterally engaging with a substantially flat flexible structure for grippingly turning the substantially flat flexible structures.

18. A method for turning continuously conveyed substantially flat flexible structures, especially printed products, arriving in an imbricated formation comprising the steps of:

conveying the substantially flat flexible structures during infeed thereof in an imbricated formation along a predetermined path of travel and at a predetermined infeed velocity;

individually laterally seizing the substantially flat flexible structures;

gradually accelerating the individually laterally seized substantially flat flexible structures such that each laterally seized substantially flat flexible structure is singled from the imbricated formation;

individually turning each such singled and laterally seized gradually accelerated substantially flat flexible structure about a deflection axis directed transversely with respect to said predetermined path of travel of the infed imbricated formation of substantially flat flexible structures;

individually gradually decelerating the turned singled and laterally seized substantially flat flexible structures; and releasing the individually and laterally seized, decelerated substantially flat structures and outfeeding the released substantially flat flexible structures in an outfeed direction opposite to the infeed conveying direction of the imbricated formation of substantially flat flexible structures.

* * * * *